US006256801B1

(12) United States Patent
Mohr

(10) Patent No.: US 6,256,801 B1
(45) Date of Patent: Jul. 10, 2001

(54) SIPHON ASSEMBLIES

(75) Inventor: Francis Michael Mohr, Draycott (GB)

(73) Assignee: Thomas Dudley Ltd., Dudley (GB)

( * ) Notice: Subject to any disclaimer, the term of this patent is extended or adjusted under 35 U.S.C. 154(b) by 0 days.

(21) Appl. No.: 09/337,281

(22) Filed: Jun. 22, 1999

(30) Foreign Application Priority Data

Jun. 24, 1998 (GB) ..... 9813472

(51) Int. Cl.[7] ..... E03D 1/14

(52) U.S. Cl. ..... 4/373; 4/415; 137/143; 137/148

(58) Field of Search ..... 4/373, 415; 137/143, 137/148, 149

(56) References Cited

FOREIGN PATENT DOCUMENTS 2270528 3/1994 (GB) .
2273510 6/1994 (GB) .
2275483 8/1994 (GB) .
2275697 9/1994 (GB) .
2304742 3/1997 (GB) .

*Primary Examiner*—Gerald A. Michalsky
(74) *Attorney, Agent, or Firm*—Wood, Phillips, VanSanten, Clark & Mortimer

(57) ABSTRACT

A siphon assembly for a flushing cistern, said assembly including an inverted generally U shaped duct having an up leg and a down leg the up leg being provided with an enlarged chamber having a lower end open to the interior of the cistern in use and the down leg forming an outlet from the cistern in use for delivery of flushing water; and a vertically displaceable piston incorporating a flexible diaphragm acting as a one way valve, said piston being movable in said chamber to initiate a siphonic flushing action operatively discharging water through said duct from the cistern; a side wall of the chamber defining a venting aperture intermediate the top of the chamber and said lower open end, the assembly further including a first closure element secured in engagement with the venting aperture, the first closure element being shaped so as to define at least a first predetermined flush level lower than a top edge of the venting aperture when so secured.

12 Claims, 3 Drawing Sheets

SIPHON ASSEMBLIES

This invention relates to siphon assemblies for flushing cisterns, said assemblies comprising an inverted generally U shaped duct having an up leg and a down leg the up leg being provided with an enlarged chamber having a lower end open to the interior of the cistern in use and the down leg forming an outlet from the cistern in use for delivery of flushing water to an associated W.C. pan or the like. A vertically displaceable piston commonly incorporating a flexible diaphragm of, for example, rubber or plastics material acting as a one way valve, is movable in said chamber to initiate a siphonic flushing action discharging water from the cistern in operation in well known manner. Such a siphon assembly is hereinafter referred to as "a siphon assembly of the kind described".

Current practice attaches increasing important to economy in water use, there have been substantial increases in the cost of water supply in recent years, many supply undertakings are metering supplies so that charges are directly related to usage, and building and other regulations are making use of modern economical appliances mandatory for new installations. Modern designs of W.C. pans have been evolved which will flush efficiently with a much less volume of water than older designs and U.K. building regulations are being brought in or under active consideration imposing a requirement that all new W.C. installations shall operate with a maximum flush volume of 7.5 liters of water instead of the 9 liter volume which was common for older patterns of W.C. Siphon assemblies therefore need to be designed to deliver this lesser volume.

There will continue to be a substantial market for siphon assemblies for the older patterns of W.C. already installed for many years to come. For economy of manufacture and economy of stocking by builders merchants and the like there is therefore a need for a siphon assembly which can readily be adapted to deliver either a higher or a lower flush volume e.g. can be selectively changed over to deliver either 9 or 7.5 liters. Proposals for such adaptable siphon assemblies are described in GB-A-2213846 and in GB-A-2270528 involving the provision of an aperture at an intermediate level in a side wall of the up leg chamber which can be selectively closed by inserting a removable snap fitting sealing plug or by means of a flap or shutter. With the aperture closed the siphonic action will continue until the water level in the cistern falls below the open bottom of the chamber, whereas with the aperture open the siphonic action will cease when the cistern water level falls below the level of the aperture, the latter allowing air to enter the chamber and so terminate the siphonic action when a lower volume of flushing water has been delivered.

However such known siphon assemblies only allow for two flush levels. The flush level being the level to which the cistern water has fallen when the siphonic action ceases. The flush volume is dependent, amongst other things, upon the flush level and also the cross-sectional area of the cistern within which the siphon assembly is installed. Thus, the installation of a siphon assembly according to GB-A-2213846 or GB-A-2270528 into a cistern of different cross-section area will produce an incorrect flush volume.

The object of the present invention is to provide an adaptable siphon assembly of the kind described which is of simple construction, economical to manufacture, and which can be readily adapted to provide a predicted flush volume, e.g. 9 liter or 7.5 liter for a wide range of cisterns.

According to the invention there is provided a siphon assembly as defined by claim 1 of the appended claims.

Examples of the invention will now be described with reference to the accompanying drawings, in which.

Figure 3:
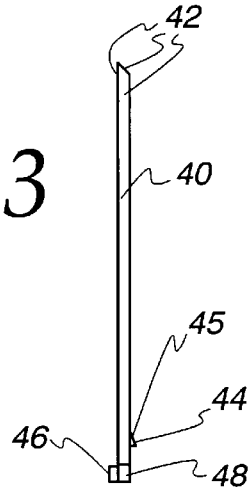
FIG. 3 is a view of the closure element of FIG. 2 taken in the direction of arrow A.
Figure 3A:
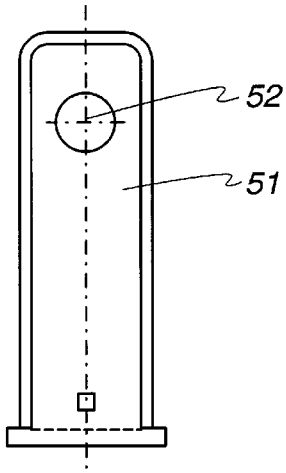

FIG. 3*a* is an elevation of a second form of closure element.

Figure 1:
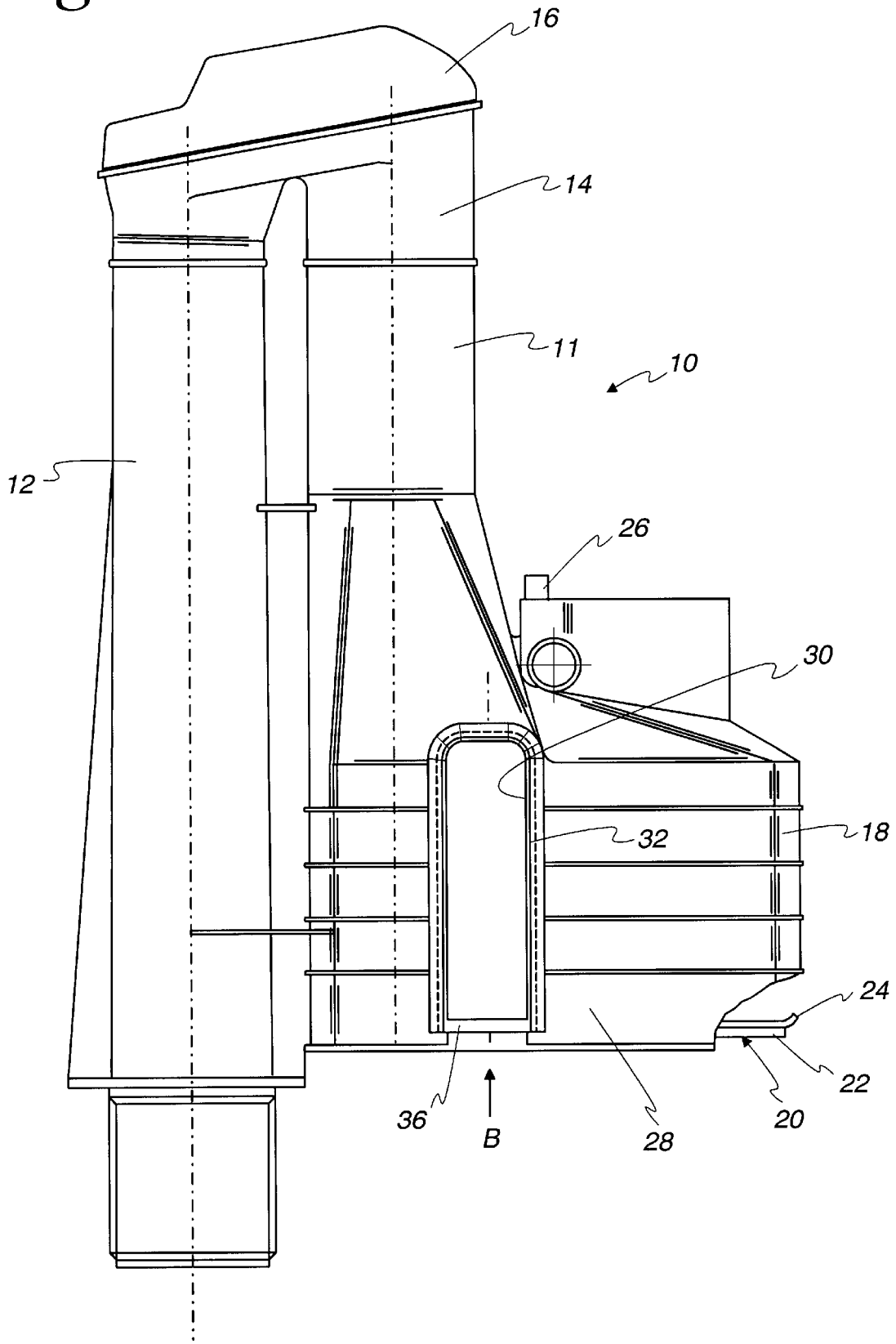
FIG. 1 is a side elevation of a siphon assembly according to the present invention but shown without a closure element for clarity.
Figure 4:
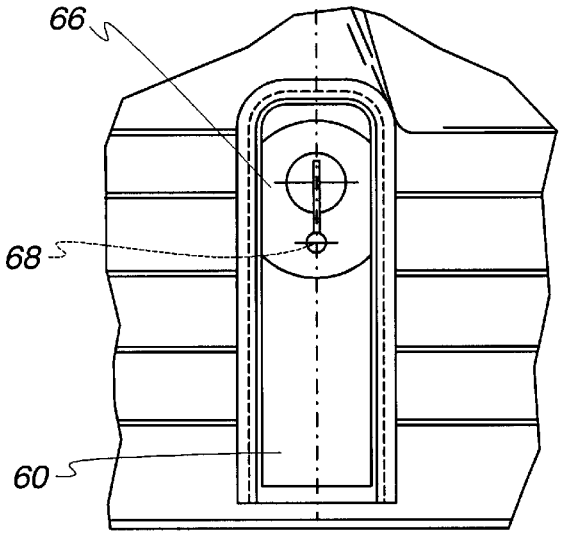
Figure 7:
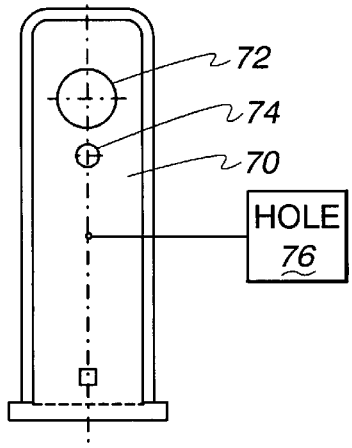
Figure 6:
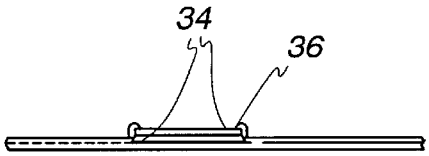
Figure 5:
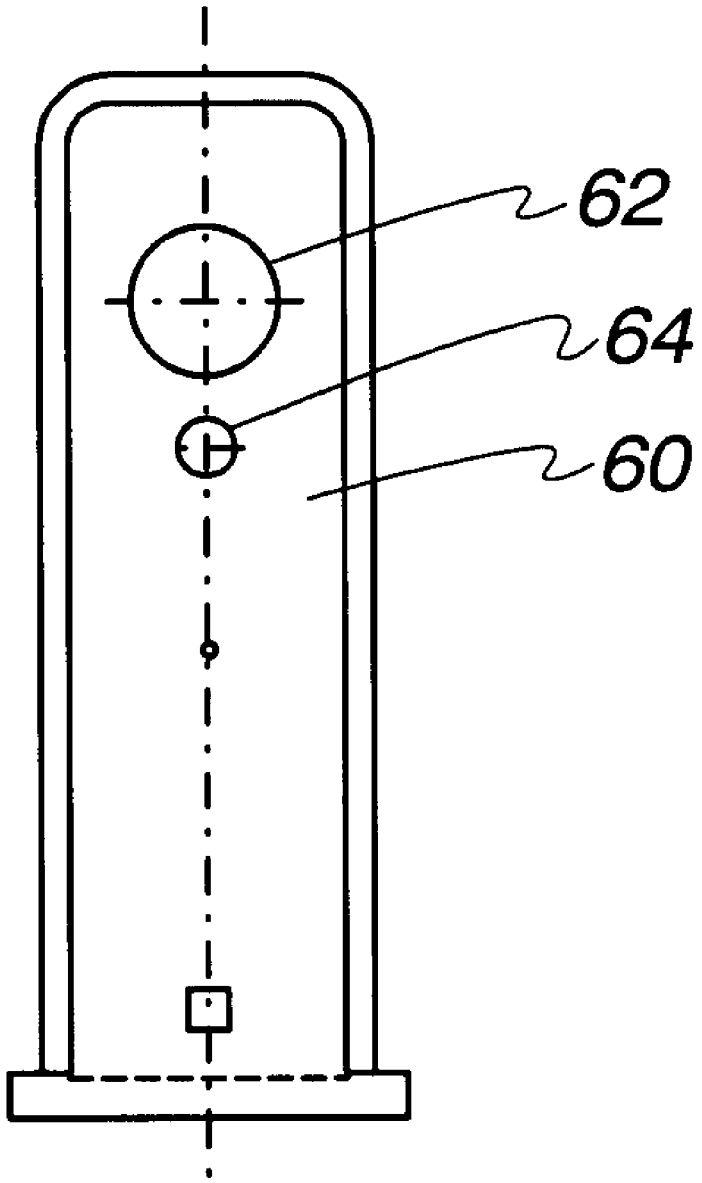

FIG. 4 is a partial side elevation view of the assembly with a third form of closure element;

FIG. 5 is an elevation of the closure element of FIG. 4;

FIG. 6 is a view of the siphon assembly of FIG. 1 taken in the direction of arrow B; and FIG. 7 is an elevation of a fourth form of closure element.

A siphon assembly 10 (FIG. 1) includes an inverted U-shaped duct 11 formed as an assembly of plastics mouldings. A down leg 12 of the duct will be secured in known manner by a screw collar in the discharge opening of an associated W.C. cistern (not shown) in use, its upper end being joined to the upper end of a parallel up leg 14 by a top joint portion 16. The lower part of leg 14 is widened to form a substantially rectangular chamber 18 having vertical side walls and a downwardly directed open mouth which will locate just above the bottom of the cistern in use.

The siphon assembly further includes a piston subassembly 20, indicated at its lowermost position, which is located within chamber 18. Subassembly 20 is of generally conventional construction including a rigid plastics support portion 22 on which rests a flexible diaphragm 24 acting as a one-way valve so that upward displacement of the piston lifts water up the up leg 14 to initiate the siphonic action but the downward return stroke is unobstructed. A rod 26 of the subassembly extends through a top wall of chamber 18 alongside up leg 14 and is actuated by a pull hook (not shown) which will be connected to a flushing lever of the cistern in the usual way.

The front side wall 28 of chamber 18 is provided with a vertically extending venting aperture 30 in the form of a generally rectangular slot, open at the lower end. Positioned around the two sides and top of the venting aperture 30 there is a slide housing 32. Around the inner periphery of the slide housing 32 there is a sealing surface 34 with a cross-section that approximates to the shape of a V (see FIG. 6). The lower ends of the slide housing 32 are joined by a bridging portion 36 which generally lies parallel to but is spaced from a plane containing the venting aperture.

Figure 2:
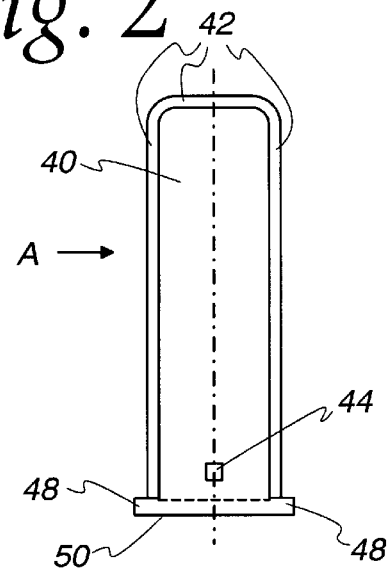
FIG. 2 is an elevation of a first form of closure element.

The siphon assembly further includes a first closure element 40 (see FIGS. 2 and 3) which is generally rectangular in shape and has a sealing surface 42 which, when the first closure element 40 is inserted into the venting aperture 30, co-operates with the sealing surface 34 to form a substantially water and air tight seal. The first closure element 40 also has a locking lug 44 projecting from one surface of the closure element and a support rib 46 projecting from the opposite surface of the closure element. Two stop lugs 48 are positioned one at each end of the sealing surface 42, with each support lug 48 projecting laterally beyond the adjacent portion of the sealing surface 42.

The first closure element 40 can be slid into the venting aperture 30 in the direction of arrow B of FIG. 1. Ultimately the ramped surface 45 of the locking lug 44 will slide under and resiliently deform the bridging portion 36. Once the locking lug 44 has passed under the bridging portion 36, the bridging portion will deflect back to the position as shown in FIG. 6 and the lower surface of the locking lug 44, in conjunction with the bridging portion 36 will prevent the first closure element 40 from sliding out of the venting aperture 30. In this position each stop lug 48 abuts an adjacent lower edge of the slide housing 32.

The support rib 46 is designed to give some structural rigidity to the lower portion of the first closure element, since when in use this area is unsupported by the slide housing 32 of the venting aperture 30.

When in use the siphon assembly 10 when including the first closure element 40 will produce a maximum flush volume since the siphonic action will only be broken when the level of water in the cistern falls to below the lower edge 50 of the first closure element 40 which in this case is substantially at the same level as the lower edge of the chamber 18.

It should be noted that it is the lower edge 50 of the closure element which defines the flush level.

FIG. 3A shows a second embodiment of a first closure element 51 identical to first closure element 40 apart from there being included an anti-siphon hole 52 positioned part way up the first closure element 51.

When first closure element 51 is included in the siphon assembly 10 the flush level is defined by the top of hole 52 and is higher than that of a similar siphon assembly 10 including a first closure element 40, thus giving a lesser flush volume.

Further embodiments of the first closure element are possible with anti-siphon holes being positioned at varying heights. The hole or holes may also be round or other shapes such as square or triangular. Furthermore the closure element could define a flush level by incorporation of a slot extending vertically from the lower edge of the closure element, the flush level thus being defined by the top of the slot of the closure element.

Thus the siphon assembly 10 can be easily adapted by inserting an appropriate first closure element to provide the required flush volume (e.g. 9 liters or 7.5 liters) in cisterns of varying cross-section.

In particular when a siphon assembly 10 is proposed to be used with a specific cistern the correct closure element can be selected from a range of different elements supplied with the assembly, the elements may be color coded to facilitate identity. Since the chosen closure element can only be fitted in a predetermined position, the flush volume will then necessarily be correct.

FIGS. 4 and 5 show a third embodiment of a first closure element 60 being identical to first closure element 40 apart from the provision of a anti-siphon hole 62 and a fixing hole 64. Mounted in the fixing hole 64 is a second closure element 66.

The second closure element 66 is of generally rectangular shape and is mounted by means of a pivot stud 68 in a face to face relationship with the outer surface of the second closure element 66. The second closure element 66 can be swung from a closed position as shown in FIG. 4 to an open position whereby anti-siphon hole 62 is exposed and is capable of breaking the siphonic action when the water level in the cistern falls to the level of the top of the anti-siphon hole 62.

Thus a siphon assembly 10 in which includes a first closure element 60 is capable of providing two distinct flush volumes, namely a higher flush volume as defined by the lower edge of the closure element when the second closure element 66 is in the position as shown in FIG. 4, and a lower flush volume as defined by the top edge of hole 62 when the second closure element 66 is either pivoted so as to expose anti-siphon hole 62 or where the second closure element 66 is removed.

Further embodiments of first closure elements are possible wherein the fixing holes 64 and the anti-siphon holes 62 are positioned as a set of holes in the same position relative to each other as shown in first closure element 60 but the set of holes being at a different level within the closure element to provide for different flush levels.

Further embodiments of first closure elements are possible, such as the closure element 70 shown in FIG. 7, wherein a set of holes 72, 74, similar to holes 64 and 62, can be positioned at an upper portion of the closure element 70 and a further anti-siphon hole 76 can be positioned at a lower portion of the closure element 70 though above the level of the lower edge of the chamber 18.

It should be noted that it is possible for a manufacturer of siphon assemblies or for a retailer of siphon assemblies to stock in an assembled form the siphon assemblies absent the closure elements along with a selection of different closure elements for each siphon assembly, since the closure elements themselves are relatively small and relatively cheap to produce when compared with the total assembly. Thus a large order for assemblies having specific flush volumes can be completed by uniting the siphon assemblies absent the closure elements with the specifically chosen closure elements. Thus it is not necessary to stock a large number of expensive completed assemblies, each being dedicated to a particular flush volume. The present invention allows stocking of a relatively small number of siphon assemblies absent a closure element and the relatively large number of cheap closure elements, thus saving on money tied up in stock items.

In the case of a siphon assembly manufacturer supplying to an original equipment manufacturer of new cisterns and toilet bowls, i.e. where only one flush level is required, the fact that the closure element is secured in a predetermined position means that it is not possible to inadvertently change the flush level.

What is claimed is:

1. A siphon assembly for a flushing cistern, said assembly including an inverted generally U shaped duct having an up leg and a down leg, the up leg being provided with an enlarged chamber having a lower end open to the interior of the cistern in use and the down leg forming an outlet from the cistern in use for delivery of flushing water; and a vertically displaceable piston incorporating a flexible diaphragm acting as a one way valve, said piston being movable in said chamber to initiate a siphonic flushing action operatively discharging water through said duct from the cistern; a side wall of the chamber defining a venting aperture intermediate the top of the chamber and said lower open end, the assembly further including a first closure element with a first edge facing vertically in one direction that abuts to a second edge on the side wall of the chamber that faces vertically and oppositely to the one direction with the first closure element in engagement with the venting aperture, the first and second edges in abutting relationship maintaining the first closure element consistently in a predetermined vertical relationship relative to the side wall of the chamber, the first closure element being shaped so that the first closure element has a third edge which is located to define at least a first predetermined flush level at the third edge on the first closure element lower than a top edge of the venting aperture with the first closure element in the predetermined position.

2. A siphon assembly as defined in claim 1 in which the venting aperture is in the form of an open ended slot.

3. A siphon assembly as defined in claim 2 in which the open end of the slot is supported by a bridging portion.

4. A siphon assembly as defined in claim 3 in which a locking formation of the first closure element engages the chamber side wall to retain the first closure element in its predetermined position during use.

5. A siphon assembly as defined in claim 1 in which the first closure element slidably engages the venting aperture.

6. A siphon assembly as defined in claim 1 in which the first closure element has an edge shape which sealingly engages a housing of the venting aperture.

7. A siphon assembly as defined in claim 1 in which the first closure element includes a first anti-siphon hole operatively defining a respective said flush level when open.

8. A siphon assembly as defined in claim 7 in which the first anti-siphon hole is selectively blockable by a second closure element.

9. A siphon assembly as defined in claim 8 in which the first closure element includes a second anti-siphon hole at an operative level different from that of the first hole.

10. A kit for providing a siphon assembly for a flushing cistern, said kit comprising:

an inverted generally U-shaped duct having an up leg and a down leg, the up leg being provided with an enlarged chamber having a lower end open to the interior of the cistern in use and the down leg forming an outlet from the cistern in use for delivery of flushing water;

a vertically displaceable piston incorporating a flexible diaphragm acting as a one way valve, said piston being movable in said chamber to initiate a siphonic flushing action operatively discharging water through said duct from the cistern, a side wall of the chamber defining a venting aperture intermediate the top of the chamber and said lower open end; and a first and second closure element each capable of being secured in a predetermined position in engagement with the venting aperture, the first closure element being shaped so as to define at least a first predetermined flush level lower than a top edge of the venting aperture with the first closure element in the predetermined position, the second closure element being shaped so that the second closure element defines at least a second predetermined flush level lower than top edge of the venting aperture with the second closure element in the predetermined position, the first predetermined flush level being different from the second predetermined flush level.

11. A siphon assembly for a flushing cistern, said assembly including an inverted generally U shaped duct having an up leg and a down leg, the up leg being provided with an enlarged chamber having a lower end open to the interior of the cistern in use and the down leg forming an outlet from the cistern in use for delivery of flushing water; and a vertically displaceable piston incorporating a flexible diaphragm acting as a one way valve, said piston being movable in said chamber to initiate a siphonic flushing action operatively discharging water through said duct from the cistern; a side wall of the chamber defining a venting aperture intermediate the top of the chamber and said lower open end, the assembly further including a first closure element securable consistently in a predetermined position in engagement with the venting aperture, the first closure element being shaped so that the first closure element defines at least a first predetermined flush level lower than a top edge of the venting aperture with the first closure element in the Predetermined position, wherein the venting aperture is in the form of an open ended slot, wherein the open end of the slot is supported by a bridging portion, wherein there is a locking lug on the closure element which engages the bridging portion.

12. The siphon assembly as defined in claim 11 wherein the bridging portion is deflectable to allow the locking lug to move against and past the bridging portion by deflecting the bridging portion as the closure element is moved towards and into the predetermined position.

* * * * *